US009953515B2

(12) United States Patent
Hanrahan

(10) Patent No.: US 9,953,515 B2
(45) Date of Patent: Apr. 24, 2018

(54) INDUCTIVE SECURITY SENSOR NOT SUSCEPTIBLE TO MAGNETIC TAMPERING

(71) Applicant: Texas Instruments Incorporated, Dallas, TX (US)

(72) Inventor: Robert M. Hanrahan, Montvale, NJ (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 14/859,215

(22) Filed: Sep. 18, 2015

(65) Prior Publication Data

US 2016/0086482 A1 Mar. 24, 2016

Related U.S. Application Data

(60) Provisional application No. 62/052,446, filed on Sep. 18, 2014.

(51) Int. Cl.

| | |
|---|---|
| ***G08B 21/00*** | (2006.01) |
| ***G08B 29/04*** | (2006.01) |
| ***G08B 13/26*** | (2006.01) |
| *G08B 13/08* | (2006.01) |

(52) U.S. Cl.

CPC ..... *G08B 29/046* (2013.01); *G08B 13/26* (2013.01); *G08B 13/08* (2013.01)

(58) Field of Classification Search

CPC ..... G08B 13/08; G08B 13/26; G08B 29/046
USPC ..... 340/506
See application file for complete search history.

(56) References Cited

U.S. PATENT DOCUMENTS

| | | | | |
|---|---|---|---|---|
| 5,065,093 | A * | 11/1991 | Nauta | G01V 3/102 324/207.12 |
| 5,504,425 | A * | 4/1996 | Fericean | G01V 3/102 324/207.16 |
| 5,712,621 | A * | 1/1998 | Andersen | G08B 13/08 324/207.16 |
| 2002/0175812 | A1* | 11/2002 | Hofmann | B66B 13/26 340/545.2 |
| 2005/0280530 | A1* | 12/2005 | Lizza | G08B 25/001 340/539.12 |

(Continued)

*Primary Examiner* — Mark Rushing
(74) *Attorney, Agent, or Firm* — Andrew Viger; Charles A. Brill; Frank D. Cimino

(57) ABSTRACT

An inductive security sensor system is not susceptible to magnetic tampering (such as by using an external magnet or false target). A sensor assembly includes an inductive sensor (inductor coil), mounted in a relatively secure location, and a conductive proximity target incorporated with an object (such as a window or door, or an object/asset). An alarm condition can be detected as either a displacement condition in which the proximity target is displaced relative to the inductive sensor, or a tamper condition in which magnetic coupling between the proximity target and the inductive sensor is interfered with (such as by introducing a false conductive target) An inductance-to-data converter drives the inductor coil with an excitation signal to project a time-varying magnetic field for magnetically coupling to the proximity target. The IDC acquires sensor measurements (such as coil inductance), which are converted into corresponding sensor data representing alarm conditions (displacement or tamper).

15 Claims, 2 Drawing Sheets

(56) References Cited

U.S. PATENT DOCUMENTS

| | | | | |
|---|---|---|---|---|
| 2009/0140728 | A1* | 6/2009 | Rollins | G01B 7/023<br>324/207.16 |
| 2012/0112910 | A1* | 5/2012 | Meyers | G08B 13/08<br>340/547 |

* cited by examiner

INDUCTIVE SECURITY SENSOR NOT SUSCEPTIBLE TO MAGNETIC TAMPERING

CROSS-REFERENCE TO RELATED APPLICATIONS

Priority is claimed under 37 CFR 1.78 and 35 USC 119(e) to U.S. Provisional Application 62/052,446, filed 18 Sep. 2014), which is incorporated by reference.

BACKGROUND

Technical Field

This Patent Disclosure relates generally to security/alarm systems designed to detect unauthorized entry/displacement conditions, such as for detecting unauthorized opening/displacement of windows/doors/objects.

Related Art

A common approach to security/alarm systems is the use of security sensors that detect unauthorized movement of objects, such as doors/windows or assets, based on proximity detection.

A common approach to a proximity-based security/alarm system uses mechanical (reed) switch sensors in conjunction with magnet targets. A reed switch sensor is located in a relatively secure (inaccessible) location, and the magnet-target is mounted/attached to an object located in secure-proximity to the sensor, such that, for secure conditions, the magnet-target is magnetically coupled to the reed switch sensor. Security/alarm detection is based on proximity of the magnet-target to the reed-switch sensor, for example the proximity of a magnet-target mounted to a window to a reed switch sensor mounted to a window frame.

Such security/alarm approaches that rely on proximity detection of a magnet-target are susceptible to being defeated using a tamper-magnet that masquerades as the magnet-target. The tamper-magnet is placed adjacent the magnet-target, in proximity to the reed-switch sensor, providing a magnetic field detected by the reed-switch sensor as the magnetic field of the magnetic-target.

BRIEF SUMMARY

This Brief Summary is provided as a general introduction to the Disclosure provided by the Detailed Description and Drawings, summarizing aspects and features of the Disclosure. It is not a complete overview of the Disclosure, and should not be interpreted as identifying key elements or features of, or otherwise characterizing or delimiting the scope of, the disclosed invention.

The Disclosure describes apparatus and methods for an inductive security sensor system that is not susceptible to magnetic tampering (such as by introducing in proximity to an inductive sensor an external magnet or false target).

According to aspects of the Disclosure, an inductive security sensor system includes an inductive sensor assembly and an inductance-to-data conversion (IDC) unit. The inductive sensor assembly includes an inductive sensor, including an inductor coil, installed in a relatively secure location, and a conductive proximity target incorporated with an object in proximity to the inductive sensor. Incorporating the proximity target with the object can be accomplished by mounting a separate proximity target onto the object. In example applications, the object can be one of a window or a door, where the inductive sensor is mounted to an associated window or door frame, or an asset mounted to or placed on a surface, where the inductive sensor is installed on the surface opposite object.

In a secure-proximity condition, the proximity target is at a secure-proximity position relative to the inductive sensor. An alarm condition occurs for either a displacement condition or a tamper condition, where a displacement condition occurs when the proximity target is displaced from the secure-proximity position by a pre-defined displacement, and a tamper condition occurs when magnetic coupling between the proximity target and the inductive sensor is interfered with without the occurrence of a displacement condition (such as by introducing a false conductive target in proximity to the inductive sensor).

The IDC unit is coupled to the inductive sensor, and drives the inductor coil with an excitation signal to project a time-varying magnetic field for magnetically coupling to the proximity target. The IDC unit acquires sensor measurements from the inductive sensor corresponding to a coil inductance of the inductor coil, and converts the sensor measurements into sensor data corresponding to coil inductance, including coil inductance representing an alarm condition for either a displacement condition or a tamper condition.

According to other aspects of the Disclosure, the inductive sensor can be configured for resonant inductive sensing, including a sensor resonator that incorporates the inductor coil. For this implementation, the IDC unit is configured to drive the sensor resonator with an excitation signal to establish a resonant state of the sensor resonator, at a sensor resonator frequency, acquire the sensor measurements based on changes in the resonance state of the sensor resonator as representing magnetic coupling between the proximity target and the inductive sensor, where the sensor measurements correspond to one of measuring changes in sensor resonator losses as representing eddy current losses in the proximity target, or measuring changes in coil inductance as representing eddy current back emf, as manifested as a change in sensor resonator frequency, and convert the sensor measurements into sensor data corresponding to the resonant state of the sensor resonator as representing the secure-proximity and the alarm conditions.

According to other aspects of the Disclosure, a wireless communication unit can be coupled to the IDC and configured to wirelessly communicate the sensor data.

Other aspects and features of the invention claimed in this Patent Document will be apparent to those skilled in the art from the following Disclosure.

DETAILED DESCRIPTION

This Description and the Drawings constitute a Disclosure for an inductive security sensor system that is not susceptible to magnetic tampering (such as by introducing in proximity to an inductive sensor an external magnet or false target) including example embodiments that illustrate various technical features and advantages.

In brief overview, an inductive security sensor system includes a sensor assembly and an inductance-to-data conversion (IDC) unit. The sensor assembly includes an inductive sensor, with an inductor coil, mounted in a relatively secure location (such as an interior portion of a window/door frame, or an interior side of a display surface), and a conductive proximity target mounted to, or otherwise incorporated with, an object (such as a window or door, or a painting, objet d'art or other asset). An alarm condition can be detected as either a displacement condition in which the proximity target is displaced relative to the inductive sensor, or a tamper condition in which inductive/magnetic coupling between the proximity target and the inductive sensor is interfered with (such as by introducing an external magnetic field, or a false conductive target). The IDC device drives the inductor coil with an excitation signal to project a time-varying magnetic field for magnetically coupling to the proximity target. The IDC acquires sensor measurements (such as coil inductance), and converts the sensor measurements into corresponding sensor data representing alarm conditions (displacement or tamper conditions).

As used in this Disclosure and the Claims, magnetic tampering means any tampering with the inductive/magnetic coupling between the inductive sensor and the proximity target intended to masquerade as a secure-proximity condition, such as by introducing in proximity to the inductive sensor an external magnet (external DC magnetic field) or a false conductive target.

Figure 1:
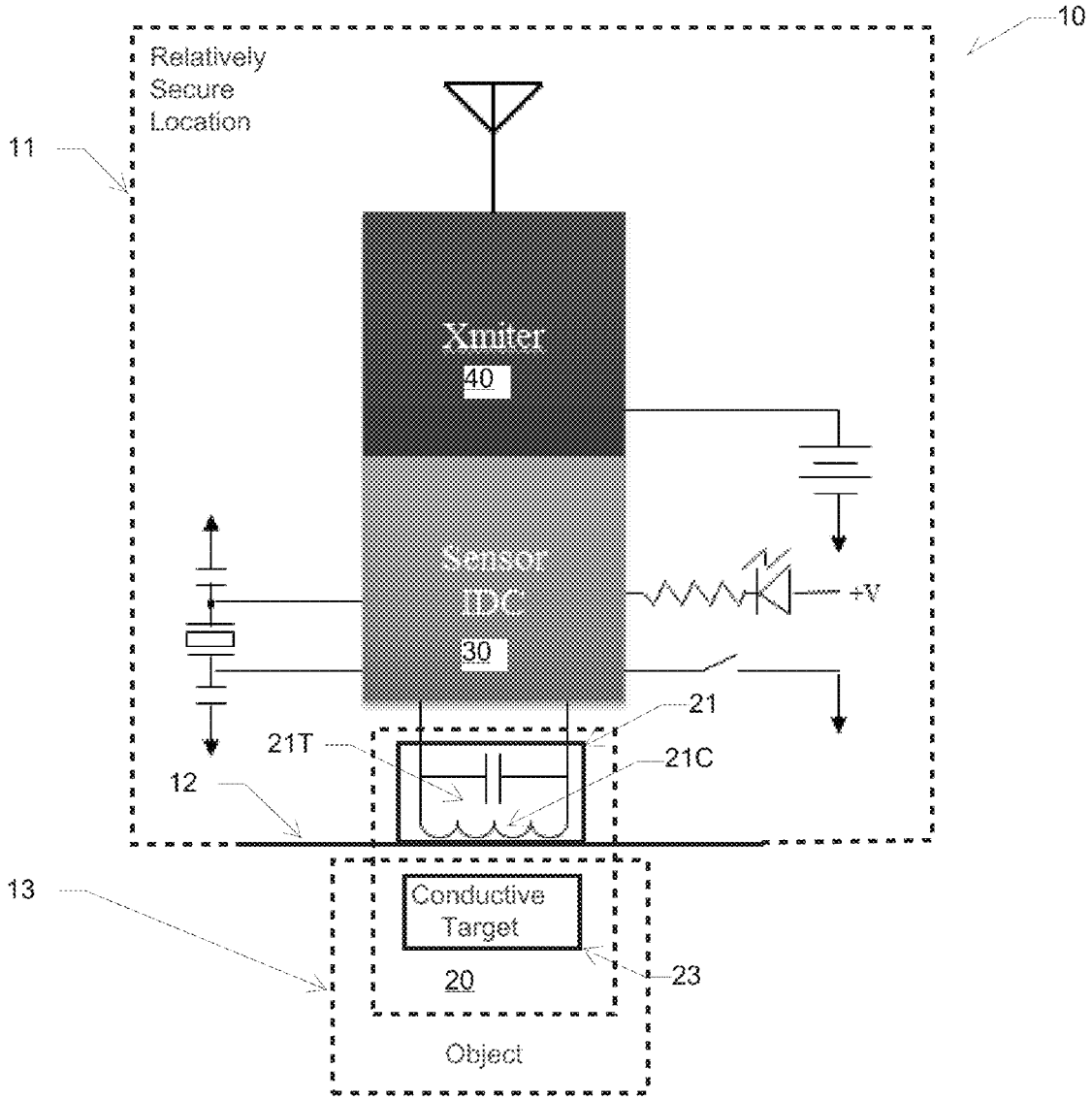
FIG. 1 illustrates an example functional embodiment of a security/alarm system (10) using an inductive security sensor system (20, 30) that is not susceptible to magnetic tampering, including an inductive sensor assembly (20) with an inductive sensor (21), including a sensor coil inductor (21C), installed in a relatively secure location (11), and in proximity with (and magnetically coupled to) a conductive proximity target, or target area, (23) mounted to, or otherwise incorporated with, an object (13) such as a window/door or asset.

FIG. 1 illustrates an example functional embodiment of a security/alarm system 10 using an inductive security sensor system 20, 30 that is not susceptible to magnetic tampering. The security sensor system includes an inductive sensor assembly 20 and sensor electronics represented by an inductance-to-data converter (IDC) 30.

Inductive sensor assembly 20 includes an inductive sensor 21 and a conductive proximity target 23. Inductive sensor 21 is a driven sensor mounted within a relatively secure location 11, at a surface 12. Proximity target 23 is incorporated with an object 13, adjacent surface 12 and in proximity to inductive sensor 21.

Conductive proximity target 23 can be incorporated with object 13 either by mounting or affixing a separate proximity target to the object, or by incorporating a proximity target as part of the structure of object. As an example of the latter configuration, proximity target 23 can be incorporated as a target area of a metal door or window sash that is adjacent an inductive sensor installed on a door/window frame.

IDC 30 drives inductive sensor 21 with an excitation signal that generates a time-varying magnetic field for magnetic coupling to the proximity target. An important advantage of the inductive security sensor system 20 is that inductive proximity sensing according to this Disclosure cannot be defeated by introducing an external DC magnetic field, or a false conductive target—an external DC magnetic field cannot be used to mimic magnetic coupling between the inductive sensor and the proximity target, and a false target will cause a change in magnetic coupling that can be sensed by the inductive sensor as a tamper condition.

IDC 30 captures sensor measurements representative of the inductive/magnetic coupling between inductive sensor 21 and proximity target 23, including sensor measurements representative of secure-proximity and alarm conditions, as described further below. IDC 30 converts the (analog) sensor measurements to corresponding sensor data. IDC 30 can include analog-to-digital conversion, converting analog sensor measurements into digital data for processing such as in a microcontroller unit (MCU).

For the example functional implementation, IDC 30 communicates sensor data wirelessly through a wireless transmitter 40.

In an example application, security/alarm system 10 is adaptable to securing windows and doors (objects 13) in a building. An inductive sensor 21 can be mounted to a window or door frame within the interior of the building (a relatively secure location 11, with proximity target 23 mounted to, or otherwise incorporated with, the window sash or door.

In another example application, security/alarm system 10 is adaptable to tamper proofing otherwise movable objects/assets 13, such as for asset management/security for paintings or objet d'art. A proximity target 23 can be mounted to (or otherwise incorporated with) an object/asset that is attached to or placed on a surface 12 (such as a wall or display case). The inductive sensor 21 can be installed on the other side of surface 12 (in a relatively secure location).

Inductive sensor 21 includes an inductive sensor coil 21C, driven by IDC 30, and configured for magnetic coupling to an associated conductive proximity target 23. Magnetic coupling based on a time-varying magnetic field induces eddy currents in the conductive proximity target 23 based on proximity. The eddy currents in proximity target 23 react back to inductive sensor 21, through sensor coil 21C, and are manifested as changes in sensor coil inductance (or sensor characteristics corresponding to coil inductance). For example, sensor measurements can be based on measuring changes in sensor losses as representing eddy current losses in the proximity target, or measuring changes in coil inductance as representing eddy current back emf.

For a secure-proximity condition, proximity target 23 is at a secure-proximity position relative to inductive sensor 21.

An alarm condition occurs for either a displacement condition or a tamper condition. A displacement condition occurs when the proximity target is displaced from the secure-proximity position by a pre-defined displacement. A tamper condition occurs when magnetic coupling between the proximity target and the inductive sensor is interfered with, such as by introducing a false conductive target in proximity to inductive sensor 21, which will cause a change in magnetic coupling detected as a change coil inductance for sensor coil 21C (or sensor characteristics corresponding to coil inductance).

IDC 30 is coupled to inductive sensor 21, and drives inductor coil 21C with an excitation signal to project a time-varying magnetic field for magnetically coupling to the proximity target. As noted, inductive sensing based on inductive/magnetic coupling cannot be defeated by introducing an external DC magnetic field (such as can be introduced by an external magnet in proximity to inductive sensor 21) in an effort to mimic magnetic coupling between inductive sensor 21 and conductive proximity target 23.

IDC 30 acquires sensor measurements from inductive sensor 21 corresponding to a coil inductance (or a sensor characteristic corresponding to coil inductance) of inductor coil 21C. The sensor measurements represent secure-proximity conditions in which proximity target 23 is in a secure-proximity condition relative to inductive sensor 21. In addition, the sensor measurements can be used to detect alarm conditions for either displacement conditions or tamper conditions: (a) a displacement condition occurs when the proximity target is displaced from the secure-proximity position by a pre-defined displacement; and (b) a tamper condition occurs when magnetic coupling between the proximity target and the inductive sensor is interfered with, such as by introducing a false conductive target in proximity to inductive sensor 21.

IDC 30 converts sensor measurements into sensor data corresponding to coil inductance (or a sensor characteristic corresponding to coil inductance), i.e. magnetic coupling between the proximity target 23 and the inductive sensor 21. In particular, the sensor data represents secure-proximity and alarm conditions.

Inductive sensor 21 can be configured for resonant sensing. For resonant sensing, inductive sensor 21 is implemented as a sensor resonator 21T, such as an LC tank circuit, incorporating sensor coil 21C. IDC 30 drives sensor resonator 21T with an excitation signal to establish a resonant state of the sensor resonator, at a sensor resonator frequency. IDC 30 captures sensor measurements corresponding to resonant state (as representing secure-proximity and tamper-displacement conditions), and converts the sensor measurements to sensor data corresponding to resonant state of sensor resonator 21T.

Sensor measurements are acquired based on changes in the resonance state of sensor resonator 21T as representing a proximity position of the proximity target relative to the inductive sensor, including the secure-proximity position and the tamper-displacement position. Sensor measurements can be based on measuring changes in sensor resonator losses as representing eddy current losses in the proximity target, or measuring changes in coil inductance as representing eddy current back emf, as manifested as a change in sensor resonator frequency.

In the case of eddy current losses, the sensor resonator losses can be characterized by series resistance Rs, or an equivalent resonator parallel impedance Rp (Rp=(1/Rs)*(L/C)), with changes in total sensor resonator impedance (1/Rp), which is a function of both inductance and resistance, measured as a change in the negative impedance (−1/Rp) required to counterbalance sensor resonator impedance, and maintain sensor resonance (sustained oscillation). In the case of sensor resonator inductance, changes in back emf caused by the induced eddy currents effectively changes sensor (coil) inductance, which is manifested as a corresponding change in resonator oscillation frequency required to maintain sensor resonance (sustained oscillation).

Figure 2A:
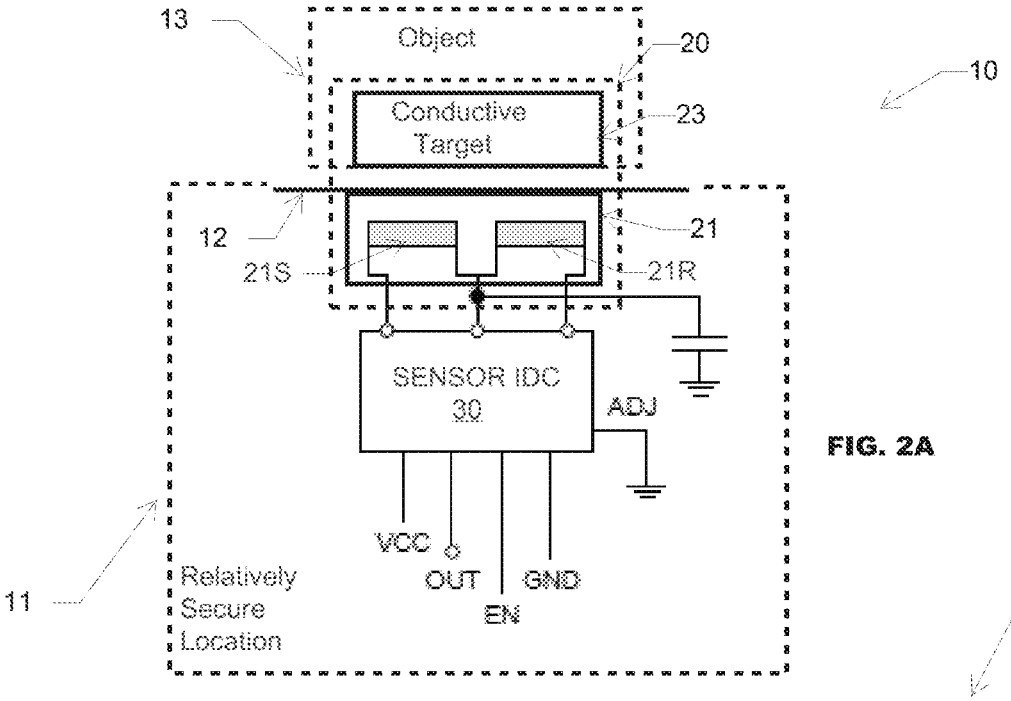
FIGS. 2A and 2B illustrate an example functional embodiment of an inductive security sensor system (20, 30) that includes an inductive sensor assembly (20), with a sensor coil 21S and a reference coil 21R, and a sensor inductance-to-data conversion (IDC) unit (30).
Figure 2B:
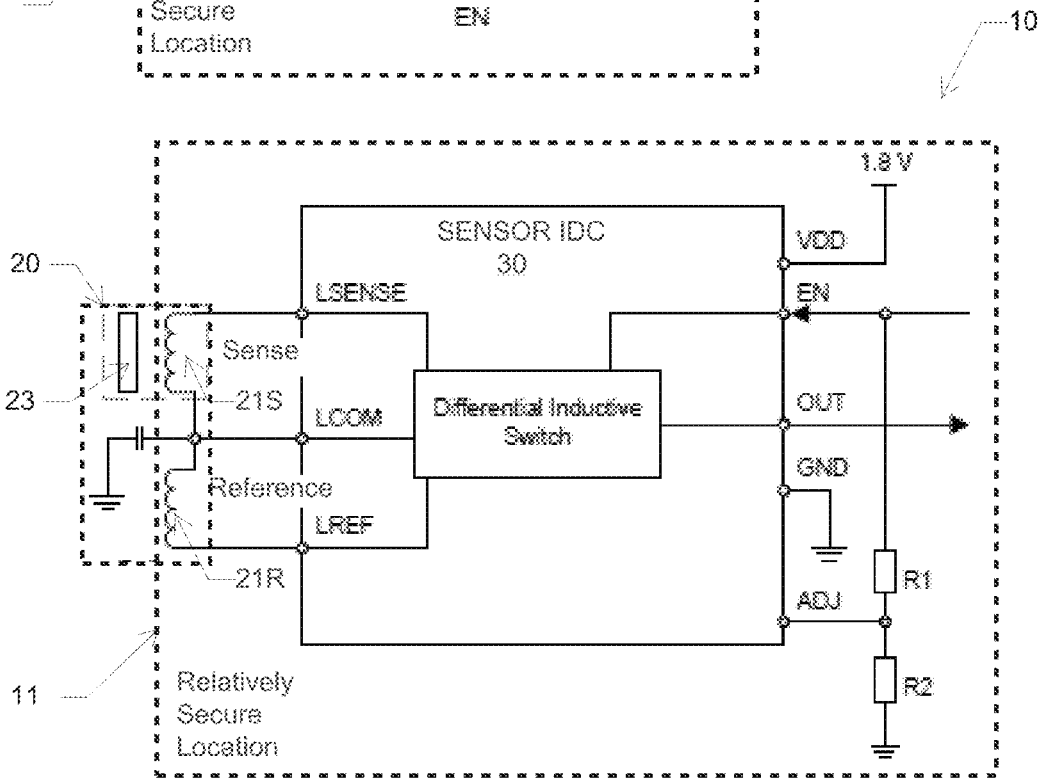

FIGS. 2A and 2B illustrates an example functional embodiment of an inductive security sensor system 20, 30. An inductive sensor assembly 20 includes a sensor coil 21S and a reference coil 21R. An IDC 30 drives the sensor/reference coils 21S/21R, and captures sensor measurements (coil inductance) for conversion to sensor data corresponding to secure-proximity and tamper-interference conditions.

Differential implementations with a reference coil (21R) can be used to improve accuracy over temperature. A dedicated enable pin allows IDC 30 to be duty cycled to lower power consumption (such as for battery operated solutions).

A noted above, an important advantage of the inductive security sensor system according to this Disclosure is that inductive proximity sensing is immune to mimicking non-alarm status by applying an external DC magnetic field, or by introducing a conductive false target. In particular, the inductive security sensor system cannot be defeated by introducing a magnet or other external DC magnetic field in proximity to inductive sensor (located in relatively secure location such as the interior of a building or a display case). Other advantages include improved reliability over mechanical designs (such as reed switches used with target magnets), and accurate sensing in the presence of non-conductive environmental interferers (such as dirt, oil or moisture).

The Disclosure provided by this Description and the Figures sets forth example embodiments and applications illustrating aspects and features of the invention, and does not limit the scope of the invention, which is defined by the claims. Known circuits, functions and operations are not described in detail to avoid obscuring the principles and features of the invention. These example embodiments and applications can be used by ordinarily skilled artisans as a basis for modifications, substitutions and alternatives to construct other embodiments, including adaptations for other applications.

The invention claimed is:

1. An inductive security sensor system, comprising
an inductive sensor assembly including:
a differential resonant inductive sensor, including differential sense and reference resonators respectively with sense and reference inductor coil, installed in a secure location in proximity to an object, and
a conductive proximity target incorporated with the object in proximity to the differential resonant inductive sensor;
such that
in a secure-proximity condition, the proximity target is at a secure-proximity position relative to the differential resonant inductive sensor, and
an alarm condition corresponds to one of
a displacement condition in which the proximity target is displaced from the secure-proximity position by a pre-defined displacement, and
a tamper condition in which magnetic coupling between the proximity target and at least the differential sense resonator is interfered with without the occurrence of a displacement condition; and
an inductance-to-data conversion (IDC) unit coupled to the differential sense and reference resonators,
to drive the sense and reference resonators with respective excitation signals to maintain respective resonance states of the differential sense and reference resonators with sustained oscillation, and to project from at least the sense inductor coil a sustained time-varying magnetic field for magnetically coupling to the proximity target, and
to acquire differential sensor measurements from the sense and reference resonators corresponding to a differential resonance state based on a resonance state of the sense resonator in differential relation to a resonance state of the reference resonator, and
to convert the differential resonance state into sensor switch data corresponding to one of the secure-proximity condition and the alarm condition.

2. The system of claim 1, wherein the tamper condition is caused by a false conductive target introduced in proximity to the differential resonant inductive sensor.

3. The system of claim 1, wherein the object is one of a window or a door, where the differential resonant inductive sensor is mounted to an associated window or door frame.

4. The system of claim 1, further comprising a wireless communication circuit coupled to the IDC unit, and configured to wirelessly communicate the sensor data.

5. An inductance-to-data conversion (IDC) device for use with a differential resonant inductive sensor, with differential sense and reference resonators respectively with sense and reference inductor coils, installed in a secure location in proximity to an object incorporating a conductive proximity target in proximity to the differential inductive sensor, such that in a secure-proximity condition, the proximity target is at a secure-proximity position relative to the differential resonant inductive sensor, the IDC comprising:

drive circuitry to drive the sense and reference resonators with respective excitation signals to maintain respective resonance states of the differential sense and reference resonators with sustained oscillation, and to project from at least the sense inductor coil a sustained time-varying magnetic field for magnetically coupling to the proximity target;

acquisition circuitry to acquire differential sensor measurements from the sense and reference resonators corresponding to a differential resonance state based on a resonance state of the sense resonator in differential relation to a resonance state of the reference resonator, including acquiring differential sensor measurements corresponding to a differential resonance state representative of an alarm condition that corresponds to one of a displacement condition in which the proximity target is displaced from the secure-proximity position by a pre-defined displacement, and a tamper condition in which magnetic coupling between the proximity target and at least the differential sense resonator is interfered with without the occurrence of a displacement condition; and data conversion circuitry to convert the differential resonance state into sensor switch data corresponding to one of the secure-proximity condition and the alarm condition.

6. The device of claim 5, wherein the tamper condition is caused by a false conductive target introduced in proximity to the differential resonant inductive sensor.

7. The device of claim 5, wherein the object is one of a window or a door, where the differential resonant inductive sensor is mounted to an associated window or door frame.

8. The device of claim 5, further comprising a wireless communication circuit coupled to the IDC unit, and configured to wirelessly communicate the sensor data.

9. A method useable in an inductive security system that monitors security based on proximity detection, including detecting secure-proximity conditions for objects, and including detecting alarm conditions, the inductive security system including for each object a differential resonant inductive sensor including differential sense and reference resonators respectively with sense and reference inductor coils, installed in a secure location in proximity to the object, the object incorporating a conductive proximity target in proximity to the differential resonant inductive sensor, such that in a secure-proximity condition, the proximity target is at a secure-proximity position relative to the differential inductive sensor, the method comprising, for each object:

driving the sense and reference resonators with respective excitation signals to maintain respective resonance states of the differential sense and reference resonators with sustained oscillation, and to project from at least the sense inductor coil a sustained time-varying magnetic field for magnetically coupling to the proximity target incorporated with the object;

acquiring differential sensor measurements from the sense and reference resonators corresponding to differential resonance state based on a resonance state of the sense resonator in differential relation to a resonance state of the reference resonator, including acquiring differential sensor measurements corresponding to a differential resonance state representative of an alarm condition that corresponds to one of a displacement condition in which the proximity target is displaced from the secure-proximity position by a pre-defined displacement, and a tamper condition in which magnetic coupling between the proximity target and at least the differential sense resonator is interfered with without the occurrence of a displacement condition; and converting the differential resonance state into sensor switch data corresponding to one of the secure-proximity condition and the alarm condition.

10. The method of claim 9, wherein the tamper condition is caused by a false conductive target introduced in proximity to the differential resonant inductive sensor.

11. The method of claim 9, wherein the object is one of a window or a door, where the differential resonant inductive sensor is mounted to an associated window or door frame.

12. The method of claim 9, further comprising a wireless communication circuit coupled to the IDC unit, and configured to wirelessly communicate the sensor data.

13. The system of claim 1, wherein the object is an asset mounted to or placed on a surface, where the differential resonant inductive sensor is installed on the surface opposite the object.

14. The device of claim 5, wherein the object is an asset mounted to or placed on a surface, where the differential resonant inductive sensor is installed on the surface opposite the object.

15. The method of claim 9, wherein the object is an asset mounted to or placed on a surface, where the differential resonant inductive sensor is installed on the surface opposite the object.

* * * * *